US005897709A

United States Patent [19]

Törefors

[11] Patent Number: 5,897,709

[45] Date of Patent: Apr. 27, 1999

[54] SUSPENSION DEVICE

[75] Inventor: Håkan Törefors, Industrivägen, Sweden

[73] Assignee: Törestorps Tråd AB, Hillerstorp, Sweden

[21] Appl. No.: 08/800,294

[22] Filed: Feb. 13, 1997

[30] Foreign Application Priority Data

Feb. 22, 1996 [SE] Sweden ..... 9600658

[51] Int. Cl.[6] ..... B05C 13/00; A47F 5/08; A47G 29/01

[52] U.S. Cl. ..... 118/500; 198/486.1; 211/113; 248/691

[58] Field of Search ..... 118/500, 504, 118/505, 630, 632, 633, 635; 198/687.1, 486.1; 211/113, 119, 123, 124, 182; 248/690, 691, 693, 215, 316.8, 303, 304, 223.21

[56] References Cited

U.S. PATENT DOCUMENTS 4,097,359 6/1978 Davitz ..... 118/500
4,217,853 8/1980 Davitz ..... 118/500
4,600,608 7/1986 Ankrett ..... 427/424
4,628,859 12/1986 Hines ..... 118/500

*Primary Examiner*—David A. Simmons
*Assistant Examiner*—Calvin Padgett
*Attorney, Agent, or Firm*—Smith, Gambrell & Russell; Beveridge, DeGrandi, Weilacher & Young Intellectual Property Group

[57] ABSTRACT

A suspension device for workpieces in electrostatic painting thereof comprises a carrier, a suspension member (2) in which the workpieces are suspended and which, by the intermediary of a connector (4) is suspended in the carrier. The suspension member (2) has an aperture (14) through which the connector (4) extends. In order to protect the suspension member (2) and the connector (4) from the build-up of layers of paint, an elastic protector device (15) is disposed to cover the suspension member (2) within an area (11) which encompasses the aperture (14), the connector (4) extending through the protector device (15).

27 Claims, 2 Drawing Sheets

SUSPENSION DEVICE

TECHNICAL FIELD

The present invention relates to a suspension device for suspending workpieces in electrostatic painting thereof, and comprises a carrier, possibly movably disposed in the form of a conveyor, at least one elongate, preferably approximately horizontal suspension member in which the workpieces are suspended and which in its turn is suspended in the carrier by the intermediary of at least one connector, the suspension member having, in an upper portion, a through-going aperture through which extends a portion of the connector.

1. Background Art

In the surface treatment of workpieces by electrostatic coating, both wet spraying and powder coating, the workpieces are as a rule suspended free from one another in a suspension device. The suspension is such that the workpieces may be got at for spraying from different directions. The suspension device includes some form of carrier which, in practice, may consist of a conveyor which carries the workpieces along a line, or a carriage which may be driven on a substrate.

In electrostatic spraying, the sprayed paint material (in the form of a powder or liquid) supplies an electric charge to the workpieces and so this charge must be conducted off to earth or to the voltage unit which is used for the charging operation, if the sprayed paint material is to adhere sufficiently to the workpiece. It follows from this that it is of cardinal importance to have good electric contact up to the workpiece. This electric contact must thus pass via the suspension device, for which reason the components included in the device must possess good conductivity and completely adequate electric contact with one another.

Given that both the workpieces and the suspension device are electrically connected to earth or to the voltage unit, it will readily be perceived that the paint material will be just as capable of adhering to the workpieces as to the metal components included in the suspension device. When the suspension device with suspended workpieces is then transported into an oven for curing the paint material, the paint material will naturally also cure onto the components included in the suspension device. As the suspension is used, the coating layer will be gradually built-up so that extremely large layer thicknesses occur.

Such paint material as has fastened to metal components included in the suspension device has involved problems in that the electric connection between these metal components cannot be maintained when the paint layer grows in thickness.

2. Problem Structure

The present invention has for its object to design the suspension device intimated by way of introduction such that it obviates the drawbacks inherent in prior art designs and constructions. In particular, the present invention has for its object to realise a suspension device which, despite the build-up of thick layers of paint material, affords good electric contact between included components. The present invention yet further has for its object to realise a suspension device which is both simple and economical in use and in which used components may readily be replaced at low cost.

3. Solution

The objects forming the basis of the present invention will be attained if the suspension device intimated by way of introduction is characterized in that a protector device of yieldable, preferably elastic material is disposed to cover the suspension member within an area which encompasses the aperture, the connector also extending through the protector device.

Further advantages will be attained if the subject matter of the present invention is also given one or more of the characterizing features as set forth below.

BRIEF DESCRIPTION OF THE ACCOMPANYING DRAWINGS

The present invention will now be described in greater detail hereinbelow, with particular reference to the accompanying Drawings. In the accompanying Drawings:

FIG. 1 schematically shows in perspective obliquely from above a suspension device according to the present invention;

FIG. 2 is a perspective view of an end portion of a suspension member included in the device according to the present invention; and FIG. 3 is a vertical section through a part of the suspension member according to FIG. 2.

DESCRIPTION OF PREFERRED EMBODIMENT

The present invention will be described and exemplified below with reference to powder spraying, but the invention may of course equally advantageously be applied in electrostatic spraying of liquid paint material, so-called wet spraying.

Figure 1:
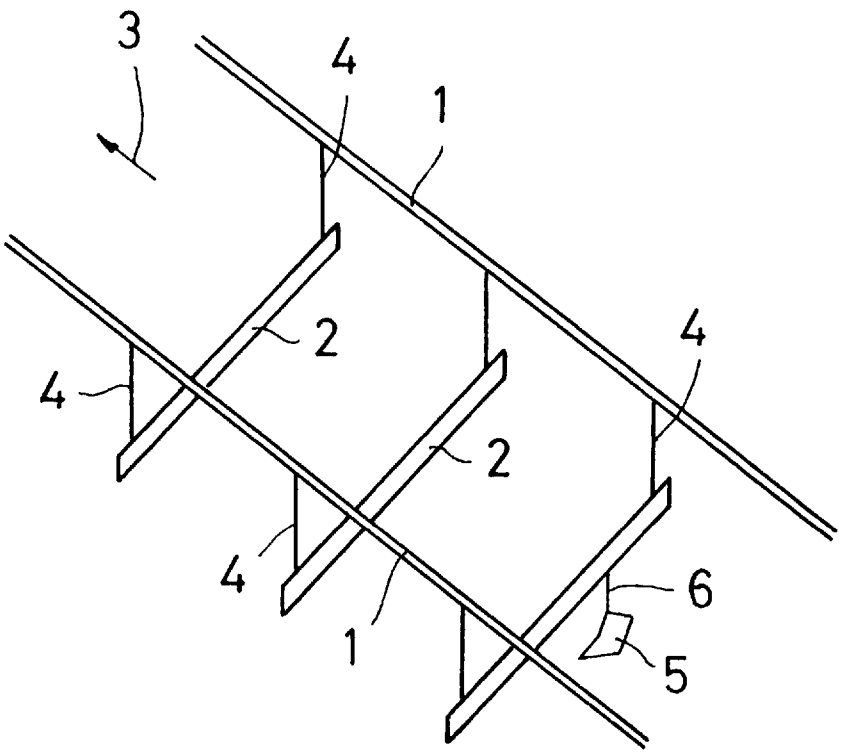

FIG. 1 schematically illustrates a highly simplified embodiment of the present invention. In the Figure, reference numeral 1 relates to a carrier which, in the illustrated embodiment, is designed as a conveyor for conveying workpieces, but which may just as well be a conveyor with a single rail. Suspension members 2 are suspended in the carrier 1 and are conveyed in the direction of the arrow 3. The suspension members are connected to the carrier 1 by the intermediary of connectors 4 which will be described in greater detail below. The suspension members 2 serve for suspending the workpieces 5 which are to be powder coated. The workpieces 5 are connected to the suspension members by means of suspension hooks 6.

While the carrier in the embodiment intimated in FIG. 1 is designed as a conveyor, it may, in an alternative embodiment, also be provided in the form of a carriage drivable on a substrate or some suitably designed rack or stand.

Figure 2:
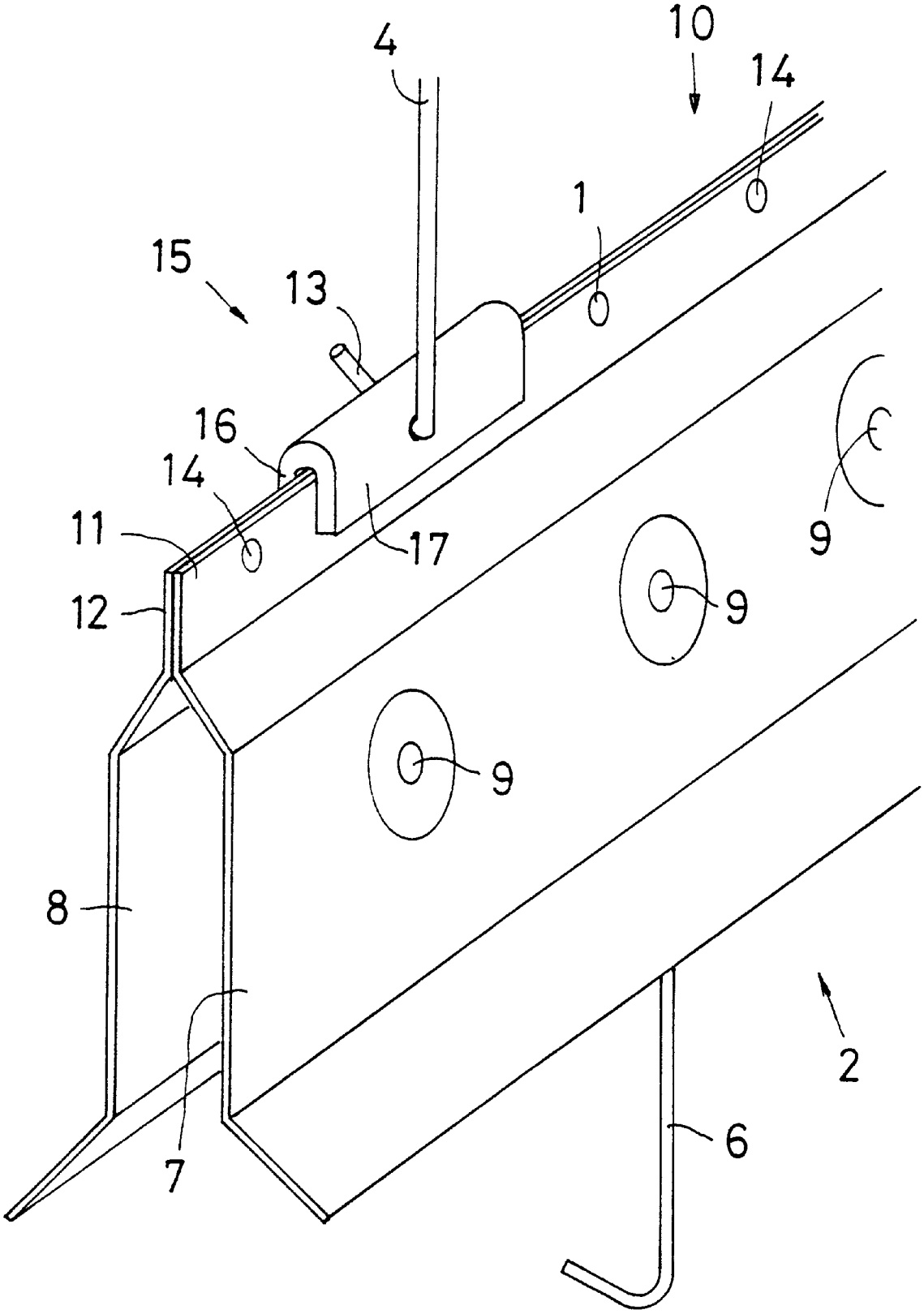

FIG. 2 shows in perspective an end portion of one suspension member 2. The suspension member 2 is elongate and is designed as a plate profile with two substantially vertical and parallel main portions 7 and 8, respectively. Along their length, the main portions 7 and 8 have a number of anchorages 9 for suspension hooks 6 in which the workpieces are subsequently intended to be suspended.

The suspension member 2 has an upper, upwardly directed portion 10 which, in the illustrated embodiment, is elongate so that it extends along substantially the entire length of the suspension member. The upwardly directed portion is strip- or band-shaped and, in the embodiment shown on the Drawing, is realized in that two sheet strips 11 and 12 laid against one another have been joined together. The sheet strips 11 and 12 are of one piece manufacture with the main portions 8 and 7, respectively, of the suspension member 2.

The suspension members 2 are suspended in the carrier 1 by the intermediary of the connectors 4 where at least the lower portions are made of metal wire. Preferably, the entire connector is produced from this material.

When the subject matter of the present invention is put into use, it is vital that there is good electric contact, first between the workpieces 5 and the suspension hooks 6, second between the suspension hooks 6 and the suspension members 2, third between the suspension members 2 and the connectors 4 and fourth and last between the connectors 4 and the carrier 1. It is possible by such means to realize good electric connection up to the workpieces 5.

On spraying with electrostatically charged powder, the suspension device according to the invention will have the same electric potential as the workpieces 5. This implies that the suspension device has the same ability to attract electrically charged powder floating in the air as the workpieces themselves. Consequently, the device according to the present invention will also receive a considerable coating of powder, since this is employed time and again and is covered with one layer after another. For this reason, the anchorages 9 are disposed interiorly between the two main portions 7 and 8 so that they will be electrically discrete from the ambient surroundings, and as a result powder can hardly penetrate in to the anchorages. It is considerably more difficult to prevent powder coating from depositing on the upwardly directed portion 10 of the suspension members serving for securement of the connectors 4.

According to the present invention, the connectors 4 have lower, hook-shaped end portions 13 which have been passed through apertures 14 in the upwardly directed portion 10 of the suspension member. A protector device 15 is produced from a resiliently yieldable, preferably elastic material and is disposed to cover that part of the upwardly directed portion 10 which encompasses any of the apertures 14. The lower, hook-shaped end portion 13 of the connector 4 extends, in this instance, through the material of the protector device 15 and through the most suitable of the apertures 14.

The protector device 15 is suitably made of a silicon rubber with good heat resistance. The protector device is elongate and has a cross section of the shape of an inverted U. In this instance, the protector device has a shank 16 and 17, respectively, on each side of the upwardly directed portion 10. The protector device is dimensioned in such a manner as to display a good fit against the upwardly directed portion, so that a seal is thereby obtained between the protector device and the upwardly directed portion. Despite the sought-for seal between the protector device and the upwardly directed portion, it may be important that the protector device is capable of carrying out minor displacement movements in relation to the upwardly directed portion so that a good electric contact is thereby guaranteed between the connector 4 and the upwardly directed portion 10.

On suspension of a suspension member 2, this is moved with the protector device over the relevant aperture 14. Thereafter, the hook-shaped end portion 13 of the connector 4 is quite simply pressed straight through the material in the protector device 15 at the same time as the end portion 13 is passed through the relevant aperture 14. There will hereby also be attained a seal fit between the protector device and the connector.

Figure 3:
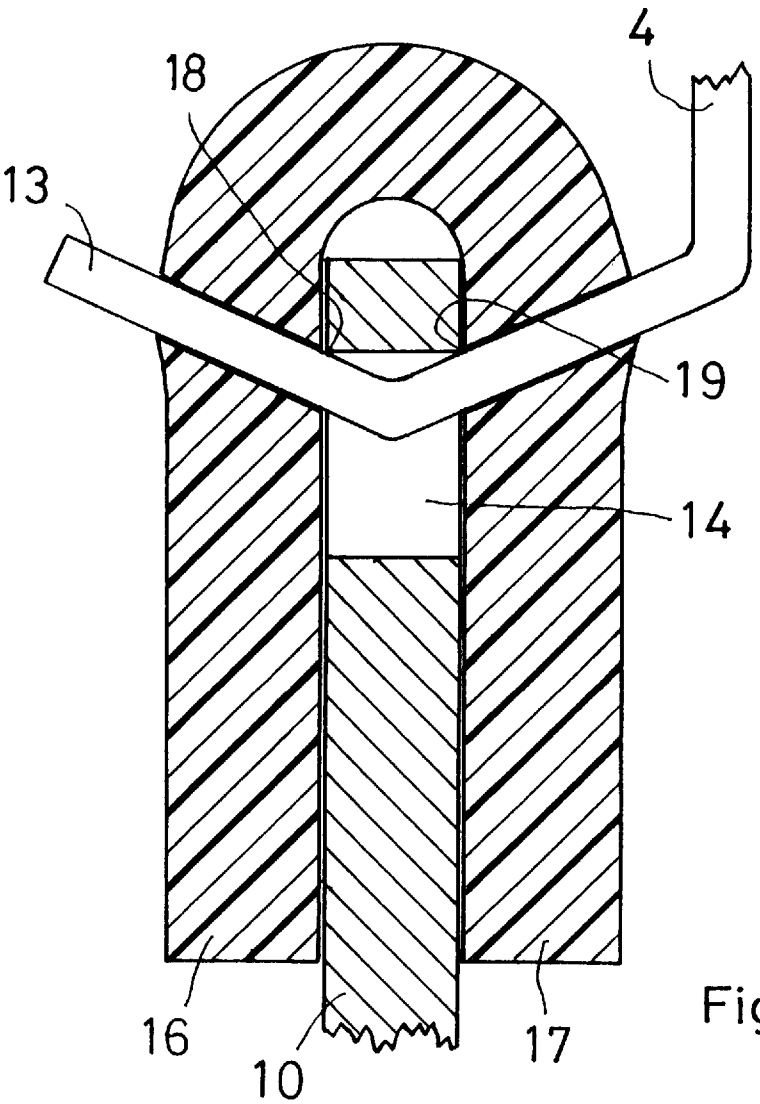

FIG. 3 is a vertical cross section through the upper portion 10 of the suspension member 2 in the region of the connector 4. It will be apparent from this Figure that both shanks 16 and 17 of the protector device 15 sealingly abut against the upwardly directed portion 10. It will also be apparent from this Figure that the edges 18 and 19 of the aperture 14 abut against the end portion 13 of the connector 4 and there realize electric contact between both of these parts.

Since the protector device 15 is made from elastic, heat resistant material, the powder which may possibly adhere therein will readily be removed even after the powder has set and cured. This implies that the region around the aperture through which the connector 4 extends may be kept free of adhering powder so that the aperture is thereby kept free at the same time as good electric conductive capacity is guaranteed.

It is advantageous if the material selected for the protector device 15 has as good dielectric properties as possible, so that the electric field force on the outside of the protector device may thereby be reduced, with the result that powder deposition on the protector device is also reduced.

In the foregoing, the upwardly directed portion 10 of the suspension member has been described as an elongate band-shaped strip on the upper side of the protector device. This design is not necessary, but instead the upwardly directed, elongate portion may be replaced by a number of upwardly directed anchorage lugs which in themselves house the above considered apertures 14. If, in such a design, the anchorage lugs have an upper, arched edge, the protector device 15 is given corresponding configuration so that, like a cap, it can be moved down over the anchorage lug.

The present invention may be modified without departing from the spirit and scope of the appended claims.

What is claimed is:

1. A suspension device for suspending workpieces in electrostatic painting thereof, comprising:

at least one carrier;

at least one elongate, approximately horizontal suspension member from which the workpieces are suspended, the suspension member having, in an upper portion, a through going aperture;

a number of suspension hooks suspending the workpieces from the suspension member;

at least one connector removably connecting the suspension member to the carrier, a portion of said connector extending through said aperture in said suspension member; and a protector device disposed to cover the suspension member within an area which encompasses the aperture, said protective device being made from a yieldable material through which said portion of said connector extends.

2. The suspension device as claimed in claim 1, characterized in that the upper portion of the suspension member provided with the aperture is in the form of an upwardly directed elongate projection and that the protector device has a cross section which is approximately in the form of an inverted U with one shank on either side of the upper portion.

3. The suspension device as claimed in claim 1, characterized in that the protector device is in substantially sealing abutment with both the upper portion of the suspension member and with the connector which is slidingly received by said protector device upon insertion of the removable connector into position on the suspension member.

4. The suspension device as claimed in claim 1, characterized in that the protector device is manufactured from a silicon rubber.

5. The suspension device as claimed in claim 1, characterized in that the protector device is formed of an elastic material and is dimensioned and arranged with respect to said suspension member as to be both releasable and displaceable in relation to the upper portion of the suspension member.

6. The suspension device as claimed in claim 1, characterized in that the lower end portion of the connector includes a conductive wire section, which is slidingly and releasably received within a hole formed in said protector device and which extends through the through going aperture in the suspension member.

7. A suspension device as claimed in claim 1, wherein said protector device is formed of an elastic material that has an opening formed therein which is aligned with said aperture, and is deformed in sealing fashion upon insertion of said portion of said connector through said opening and into said aperture.

8. A suspension device as claimed in claim 1, where said protector device is formed of a dielectric material.

9. A suspension device as claimed in claim 1, wherein said suspension member includes an upwardly, vertically extending projection at the upper end of said suspension member and a main body extending below said upper end which is formed of two plate profiles spaced from one another to form an internal cavity for receipt of one end of said suspension hooks, and said through going aperture extending in a horizontal direction through said upwardly extending projection.

10. A suspension device for suspending workpieces in electrostatic painting thereof, including:

at least one carrier;

at least one elongate, approximately horizontal suspension member, said suspension member having internally thereof anchorages in an electrically shielded space; said suspension member further having, in an upper portion thereof, a through going aperture;

a number of suspension hooks supported by the anchorages for suspending the workpieces from the anchorages;

at least one connector connecting the suspension member to the carrier; and a protective device disposed to cover the suspension member within an area that encompasses the aperture, said protective device being made from a yieldable material, and said connector extending both through the protective device and the aperture.

11. A suspension device as recited in claim 10, wherein said at least one connector has an insertion portion which is slidingly received by said protective device and which extends within said through going aperture, and said protective device being formed of a sealably conforming elastic material which receives in sealing fashion the insertion portion.

12. A suspension device as recited in claim 10, wherein said protective device is formed of a dielectric material.

13. A suspension device as recited in claim 10, wherein said suspension member has a pair of juxtaposed plate sections partially defining the electrically shielded space, and said suspension device further comprising an upwardly extending projection that extends upwardly with respect to said plate sections to define the upper end of said suspension member, and said through going aperture extends in a horizontal direction in extending through said upwardly extending projection such that an insertion portion of said connector received by said aperture comes in supporting, conductive contact with a portion of said upper end defining said aperture.

14. A suspension device as recited in claim 13, wherein said upwardly extending projection extends longitudinally with said plate member and said upwardly extending projection has a plurality of through going apertures spaced therealong.

15. A suspension device as recited in claim 10, wherein said protective device is an elastic member having a U-shaped cross-section with an uninterrupted back and two shank sections defining an internal cavity, and said protective device having a hole formed in a shank section that extends into the internal cavity, and said shank sections being spaced apart to sealingly conform to the upper end of said suspension member.

16. A suspension device as recited in claim 15, wherein said hole in the shank section is aligned with said through going aperture in the upper end, and a wire extension of said at least one connector is received in sealing fashion within said hole and received by said through-going aperture so as to be in electrically conductive contact with said upper end of said suspension member.

17. A suspension device as recited in claim 10, wherein said protective device is formed of a dielectric rubber material.

18. A suspension device for suspending workpieces in electrostatic painting thereof, comprising:

at least one carrier;

at least one elongate, approximately horizontal suspension member from which the workpieces are suspended, said suspension member having, in an upper portion thereof, an aperture;

at least one connector connecting the suspension member to the carrier; and a protective device disposed to cover the suspension member within an area covering the aperture, said protective device being made from an elastic material and said connector extending both through the protective device and the aperture, and said protective device having a substantially sealing abutment both to the connector and to the suspension member.

19. A suspension device as claimed in claim 18, wherein said protective device is formed of a flexible dielectric rubber material.

20. A suspension device as recited in claim 18, wherein said suspension member has a pair of juxtaposed plate sections, and said suspension member further comprising an upwardly extending projection that extends upwardly with respect to said plate sections to define the upper end of said suspension member, and said aperture extends in a horizontal direction in extending through said upwardly extending projection such that an insertion portion of said connector received by said aperture comes in supporting conductive contact with a portion of said upper end defining said aperture.

21. A suspension device as recited in claim 18, wherein said upwardly extending projection extends longitudinally with said plate member and said upwardly extending projection has a plurality of connector reception apertures spaced therealong.

22. A suspension device as recited in claim 18, wherein said protective device is an elastic member having a U-shaped cross-section with an uninterrupted back and two shank sections defining an internal cavity, and said protective device having a hole formed in a shank section that extends into the internal cavity, and said shank sections being spaced apart to sealingly conform to the upper end of said suspension member.

23. A suspension device as recited in claim 22, wherein said hole in the shank section is aligned with said aperture in the upper end, and a wire extension of said at least one connector is received in sealing fashion within said hole and received by said aperture so as to be in electrically conductive contact with the upper end of said suspension member.

24. A suspension device for supporting workpieces to be subjected to an electrostatic coating process, comprising:

a suspension member which has an aperture;

a connector which is connected to said suspension member by way of a first connector portion that is releasably received by the aperture of said suspension member and is in electrical contact with said suspension member when received by the aperture, and said connector has a second connector portion configured for attachment with an electrostatic process carrier;

a protector device formed of an elastic material and positioned as to cover said suspension member in an area surrounding the aperture of said suspension member, and said first connector portion also extending into an opening in said protector device so as to be in contact with said protector device; and a workpiece support member which is in electrical contact with said suspension member and extends out away from said suspension member for engagement with a workpiece.

25. A suspension device as recited in claim 24 wherein said protector device is formed of a deformable sealing material to provide a sealing engagement between said protector device and said first connector portion of said suspension member.

26. A suspension device as recited in claim 25 wherein said protector device is formed of a dielectric material.

27. A suspension device as recited in claim 24 wherein said connector is a rod member having an upper end with means for engagement with a carrier member and a lower end with a substantially hook shaped configuration extending through said protector device, and said aperture and said workpiece support member having an upper section attached to said suspension member and a lower section with a workpiece engaging member.

* * * * *